US008507799B2

(12) United States Patent
Johnson et al.

(10) Patent No.: US 8,507,799 B2
(45) Date of Patent: Aug. 13, 2013

(54) ELECTRIC FENCE INSULATOR AND DEAD END

(75) Inventors: Darnell Johnson, Mayfield Heights, OH (US); Ryan Ruhlman, South Euclid, OH (US)

(73) Assignee: Preformed Line Products, Mayfield Village, OH (US)

( * ) Notice: Subject to any disclaimer, the term of this patent is extended or adjusted under 35 U.S.C. 154(b) by 70 days.

(21) Appl. No.: 13/313,572

(22) Filed: Dec. 7, 2011

(65) Prior Publication Data

US 2013/0146331 A1 Jun. 13, 2013

(51) Int. Cl.
*H01B 17/16* (2006.01)

(52) U.S. Cl.
USPC ..... 174/163 F; 174/161 F; 174/158 R; 256/10; 256/42; 248/72

(58) Field of Classification Search
USPC ..... 174/158 R, 161 F, 163 F; 256/42, 256/47, 19, 10; 248/72
See application file for complete search history.

(56) References Cited

U.S. PATENT DOCUMENTS

| | | | | |
|---|---|---|---|---|
| 3,001,765 | A * | 9/1961 | Shobert | 256/10 |
| 4,070,007 | A * | 1/1978 | Minor et al. | 256/19 |
| 4,111,400 | A * | 9/1978 | Enoksson | 256/47 |
| 4,580,767 | A * | 4/1986 | Zimmerman | 256/10 |

* cited by examiner

*Primary Examiner* — Dhirubhai R Patel
(74) *Attorney, Agent, or Firm* — Kegler Brown Hill & Ritter; James J. Pingor

(57) ABSTRACT

An apparatus is provided that electrically insulates an elongate body from a rigid member. The apparatus includes an insulating part and a helically shaped securing part. The insulating part contacts either the elongate body or the rigid member thereby electrically insulating the elongate body from the rigid member. The helically shaped securing part prevents the insulating part from moving. The helically shaped securing part includes a multiple continuous rods, whereby the multiple rods are individual rods or sets of rods where at least two of the continuous rods are adhered together with an adhesive to form a set.

24 Claims, 5 Drawing Sheets

ELECTRIC FENCE INSULATOR AND DEAD END

ORIGIN

The innovation disclosed herein relates to insulators and more specifically, to insulators that connect and/or insulate an electrically energized wire of an electric fence to a fence post.

BACKGROUND

Electric fences are barriers used both for security and animal control. Specifically, electric fences use electric shocks to deter animals and/or people from crossing a boundary. Conventional electric fence configurations require a path to a source of an electric current and ground or earth. A power energizer converts power into a brief high voltage pulse. One terminal of the power energizer releases an electrical pulse along a bare wire. Another terminal is connected to a metal rod implanted in the earth, called a ground or earth rod. An animal touching the wire and the earth simultaneously will complete an electrical circuit thus, conducting the electrical pulse, and thereby receiving an electrical shock. The connected bare wire is usually a smooth high tensile steel wire, which prevents the fence from sagging. This, however, can increase the risk of entanglement or possible escape.

In addition, the electric fence must be kept insulated from the earth and any materials that will conduct electricity, burn, or short out the fence. Further, the electric fence (i.e., bare wire) cannot be attached directly to the posts. Thus, insulated connectors are required to attach the bare wire to the fence posts to thereby insulate the bare wire from the fence posts. The insulated connectors need to provide a secure connection to support the bare wire and prevent the bare wire from sliding along the fence post. In order to accomplish this, some conventional connectors require special tools to install or replace the insulated connectors.

Other types of insulators are simply tube insulators that are slid along the bare wire to the proper location along the fence to insulate the wire from intermediate posts. All of the tube insulators necessary for the line must be slid along the bare wire prior to installing the bare wire. Thus, the number of insulating tubes must match the number of intermediate posts. The installer typically loads up the bare wire by installing many insulators at one end and sliding them down the entire length of the bare wire until each insulator reaches its respective post. Further, once the electric fence is complete, the bare wire must be removed in order to replace any one of the insulating tubes.

SUMMARY

The following presents a simplified summary in order to provide a basic understanding of some aspects of the innovation. This summary is not an extensive overview of the innovation. It is not intended to identify key/critical elements or to delineate the scope of the innovation. Its sole purpose is to present some concepts of the innovation in a simplified form as a prelude to the more detailed description that is presented later.

In one aspect of the innovation, an apparatus is provided that electrically insulates an elongate body from a rigid member. The apparatus includes an insulating part and a helically shaped securing part. The insulating part contacts either the elongate body or the rigid member thereby electrically insulating the elongate body from the rigid member. The helically shaped securing part prevents the insulating part from moving. The helically shaped securing part is comprised of multiple continuous rods, whereby the multiple rods are individual rods or sets of rods where at least two of the continuous rods are adhered together with an adhesive to form a set.

In another aspect of the innovation, an apparatus is provided that insulates an elongate body from a rigid member. The apparatus includes a helically shaped first leg, a helically shaped second leg, and a substantially U-shaped part connecting the helically shaped first leg and the helically shaped second leg such that the helically shaped first leg, the helically shaped second leg and the U-shaped part are continuous. The U-shaped part includes a bight part and an insulating material disposed between the bight part and the rigid member. The bight part loops around a back of the rigid member, and the helically shaped first leg and the helically shaped second leg engage the elongate body in an alternating arrangement thereby securing the elongate body to the rigid member. The insulating material insulates the elongate body from the rigid member.

In yet another aspect of the innovation, a method of insulating an elongate member from a rigid member is provided. The method includes applying an insulating part to the elongate member, applying a casing around the insulating part, and securing the casing and insulating part the rigid member with a fastening device. The method further includes inserting the elongate member through a slit in the insulating part, wherein the insulating part is a cylindrical tube.

To accomplish the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
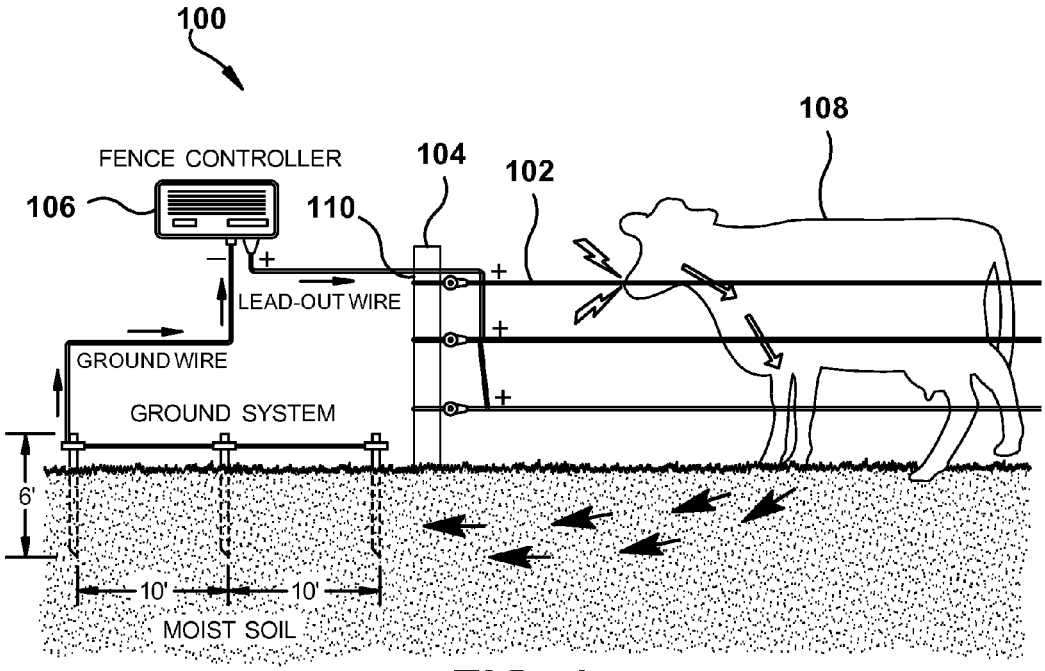
FIG. 1 is illustrates an example electric fence system in accordance with an aspect of the innovation

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details.

While specific characteristics are described herein (e.g., dimensions, thickness), it is to be understood that the features, functions and benefits of the innovation can employ characteristics that vary from those described herein. These alternatives are to be included within the scope of the innovation and claims appended hereto.

With reference now to the figures, FIG. 1 is an illustration of a partial view of an electric fence system 100 that includes electrically conductive wires 102, a fence post 104, and a controller (power energizer) 106. As explained above, the controller 106 releases an electrical pulse along the wires 102. Thus, when an object 108, such as an animal, comes in contact with one of the wires 102 and the ground simultaneously, an electric circuit is completed and the object 108 receives a shock. As will be understood, the wires 102, however, must remain insulated from the fence posts 104, including the end posts (shown in FIG. 1) and any intermediate posts (not shown). The innovation disclosed herein provides example embodiments of an apparatus that insulates the wires 102 from the fence posts 104 or other like structures.

Figure 2:
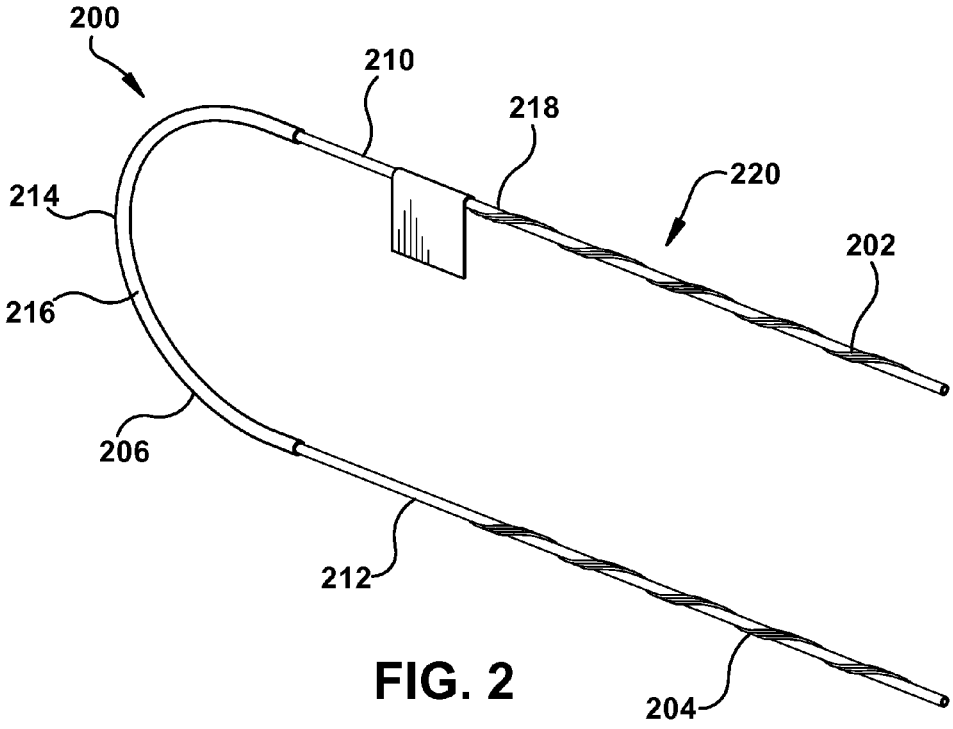
FIG. 2 is a perspective view of one example embodiment of an insulator in accordance with an aspect of the innovation.
Figure 3:
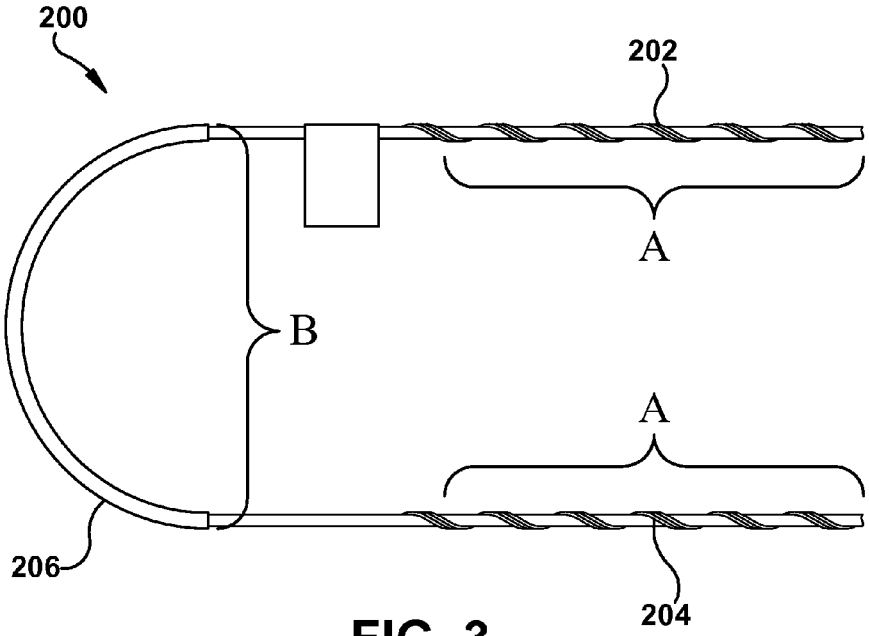
FIG. 3 is a top view of the example insulator of FIG. 2 in accordance with an aspect of the innovation.
Figure 4:
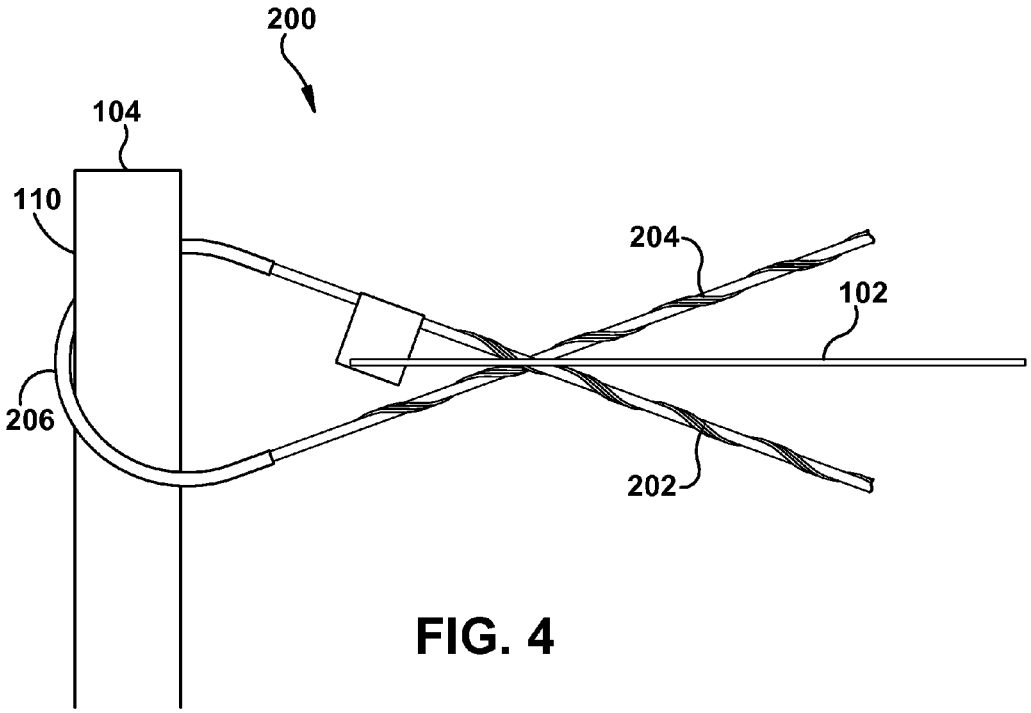
FIG. 4 is another top view of the example insulator of FIG. 2 in accordance with an aspect of the innovation.

FIGS. 2-4 illustrate one example embodiment of the innovation. FIG. 2 is a perspective view of an apparatus 200 that secures an elongate body (e.g., wire) to a rigid member (e.g., post). For example, the apparatus 200 can be used as a connector that includes a securing part that secures the wire (elongate body) 102 of the electric fence system 100 to the electric fence end post (rigid member) 104, as illustrated in FIG. 1. The apparatus 200 also includes an insulating part that insulates the wire 102 from the end post 104. In addition, the apparatus 200 has the capability of holding tension in the wire 102 without the use of special tensioning tools, as explained above.

Referring to FIGS. 2 and 3, the apparatus 200 includes a helically shaped first leg 202, a helically shaped second leg 204, and a substantially U-shaped part 206 (hereinafter "U-shaped part"). The helically shaped first and second legs 202, 204 comprise the securing part "A" (see FIG. 3). The U-shaped part 206 connects the helically shaped first leg 202 and the helically shaped second leg 204. The U-shaped part 206 includes a first leg 210, a second leg 212, and a bight part 214. The bight part 214 connects the first leg 210 and the second leg 212, and includes an insulating material 216. The insulating material 216 comprises the insulating part "B" (see FIG. 3) and electrically insulates the wire 102 from the fence post 204. In the example embodiment shown in FIGS. 2-4, the insulating material encompasses the bight part 214. It is to be appreciated, however, that the insulating material 216 need not encompass the bight part 214. Rather, the insulating part 216 may partially encompass the bight part 214 or may be disposed on an inside portion of the bight part 214 such that the insulating material 216 is disposed between the bight part 214 and the rigid member 104. In still yet another example embodiment, the apparatus 200 may be made from a suitable insulating material, such as but not limited to plastic. In still yet another embodiment, the rigid member 104 may be made from a suitable insulating material, such as but not limited plastic.

The helically shaped first leg 202, the helically shaped second leg 204, and the U-shaped part 206 are formed from a continuous-protective rod 218. In some aspects of the innovation, the rods 218 are formed from an aluminum material, such as an aluminum coated steel material or the like. In other aspects, the rods 218 may be formed of a suitable insulating material, such as but not limited to plastic. Two or more rods 218, which form a plurality (or group) of rods 220, form the apparatus 200. The number of rods 218 used to form the apparatus 200 is dependent on an outside diameter of the object that the rods 218 protect, such as the elongate body 102 (e.g., wire). Specifically, it is desired to use an appropriate number of rods 218 such that the rods 218 encase the elongate body 102 to: 1) ensure that the apparatus 200 adequately secures the elongate body 102 to the rigid member 104, and 2) to provide protection to the elongate body 102. Examples of proper and improper arrangements of applying the rods 218 to the elongate body 102 will be explained further below with reference to FIG. 8.

A spiral direction, also known as a lay direction, of the helically shaped first leg 202 and the helically shaped second leg 204 are substantially the same. This arrangement allows the helically shaped first and second legs 202, 204 to wrap around the elongate body 102 in an alternating arrangement (see FIG. 4) to form a casing around the elongate body 102. Alternating the helically shaped first and second legs 202, 204 allows axial tensile loads to be transferred in a substantially constant, equally distributed, radial force that is torque balanced along the length of the helically shaped first and second legs 202, 204. This arrangement prevents damage to the elongate body 102.

Figure 8:
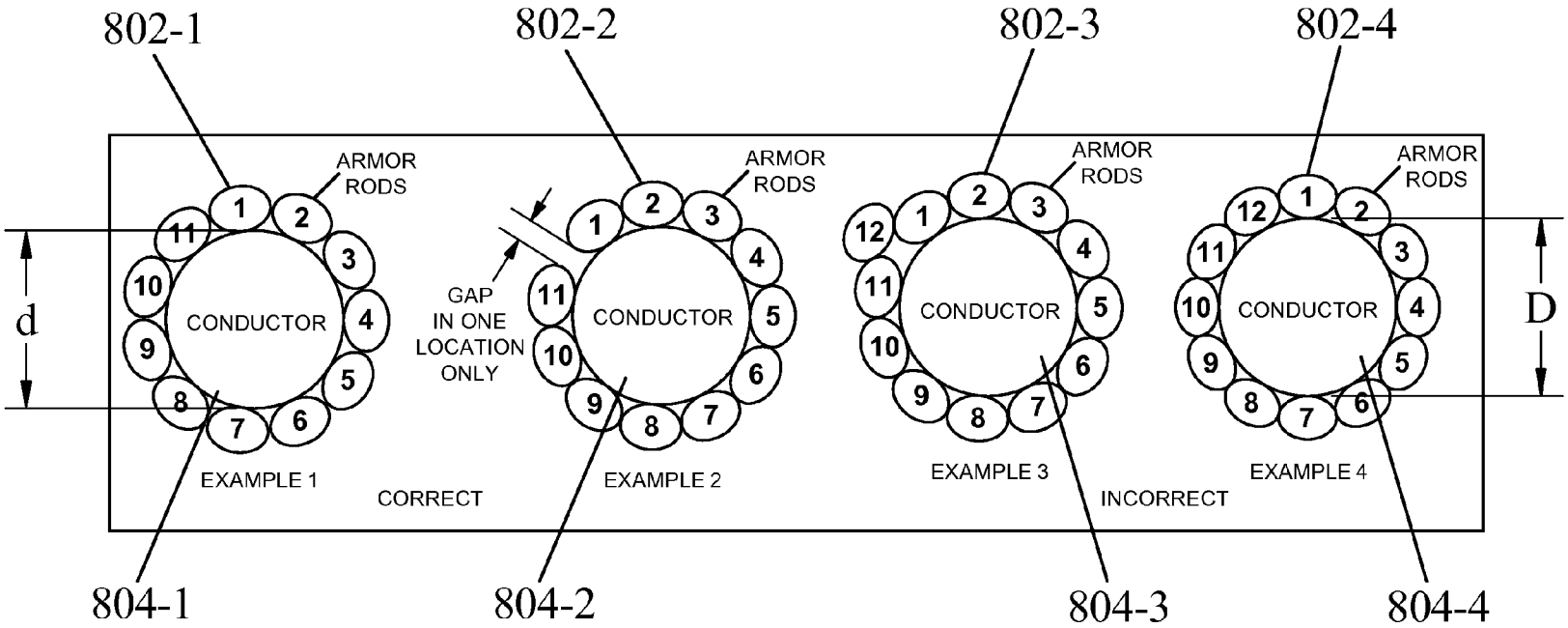
FIG. 8 is cross sectional views illustrating example proper and improper arrangements of protector rods of an associated insulator in accordance with an aspect of the innovation.

Further, the helically shaped first and second legs 202, 204 are preformed to have a pitch length sufficiently long enough so that they can be applied in a sideways manner to the elongate body 102. In addition, as shown in FIG. 8, internal diameters "d" of the helically shaped first and second legs 202, 204 are less than an outside diameter "D" of the elongate body 102. The internal diameters "d", however, should be sufficiently large enough so that the elastic limit of the material is not exceeded. This arrangement allows both the helically shaped first and second legs 202, 204 to be in contact with and grip the elongate body 102 with sufficient strength, thereby securing the elongate body 102 to the rigid member 104.

Installing the apparatus 200 is rather simple. The bight part 214 is simply placed around a back part 110 of the rigid member 104 and the helically shaped first and second legs 202, 204 extend in a direction toward the elongate body 102. It is to be appreciated that in other embodiments the bight part may attached to either side of the rigid member 104 with a fastening device, such as but not limited to a screw, nail, hook, etc. The helically shaped first and second legs 202, 204 are then arranged to engage the elongate body 102 in the alternating fashion described above thereby securing the elongate body 102 to the rigid member 104. Once the apparatus 200 is in place, the insulating material 216 encompassing the bight part 214 is in contact with the rigid member 104 (end fence post) thereby insulating the elongate body 102 from the rigid member 104.

The example embodiment described above and illustrated in FIGS. 2-4 eliminates the use of special tensioning tools. Further, the example embodiment also eliminates the use of multiple parts required for attaching the electric wire to the end fence post and for tensioning the electric wire. As a result, assembly and installation time to attach the electric wire to the end fence post is reduced.

Figure 5:
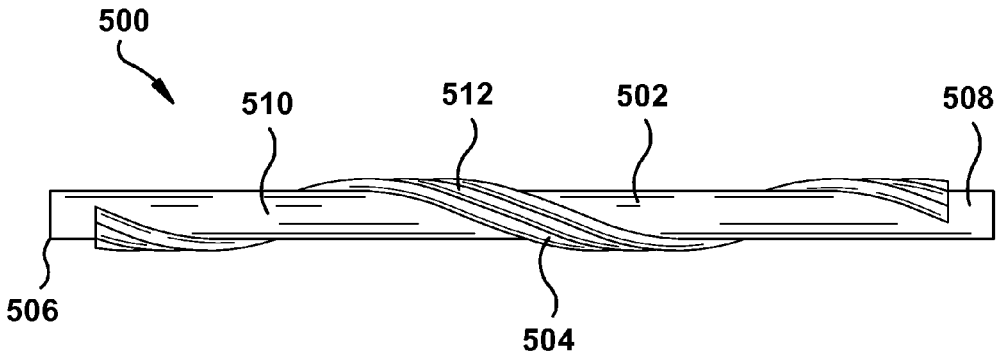
FIG. 5 is a front view of another example embodiment of an insulator in accordance with an aspect of the innovation.
Figure 6:
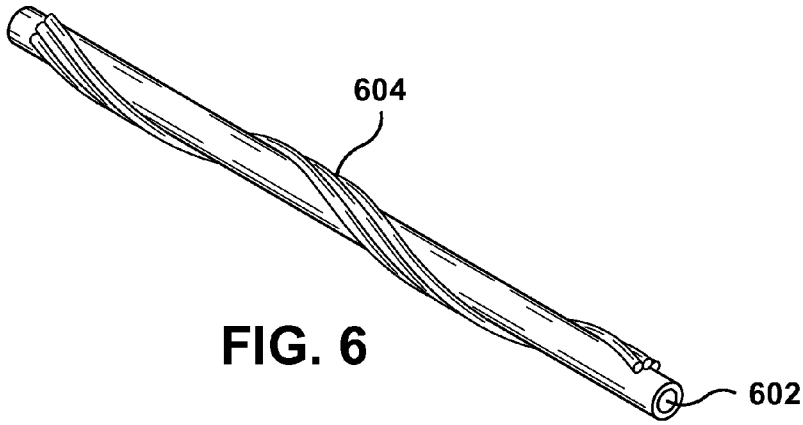
FIG. 6 is a perspective view of the example insulator of FIG. 5 in accordance with an aspect of the innovation.

FIGS. 5 and 6 illustrate another example embodiment of the innovation. FIG. 5 is a front view of an apparatus 500 that includes an insulating part that insulates an elongate body from a rigid member and a securing/protecting part that secures the insulating part to the elongate body and protects the insulating part from damage due to external forces. For example, the apparatus 500 can be used as a tube insulator that insulates the wire (elongate body) 102 of the electric fence system 100 from intermediate electric fence posts (rigid member—not shown).

Referring to FIG. 5, the apparatus 500 includes a cylindrical part (insulating part) 502 and a helically shaped casing part (securing/protecting part) 504 (hereinafter "casing part"). The cylindrical part 502 includes a first end 506, a second end 508, a slit 510, and a passage 602 (see FIG. 6) extending from the first end 506 to the second end 508 that receives the elongate body 102. The slit 510 extends from the first end 506 to the second end 508 in an angled direction and runs substantially parallel to and along the length of the cylindrical part 502. The angle of the slit 510 minimizes the possibility of the cylindrical part 502 becoming easily dislodged from the elongate body 102. The slit 510 also facilitates the installation of the cylindrical part 502 and ultimately the apparatus 500 at any point along the elongate body 102 without removing the elongate body 102 from the rigid member 104, as will be explained further below.

In another embodiment, the cylindrical part 502 may be in the shape of a spiral or continuous coil. To install the cylindrical part around the elongate body 102, the elongate body 102 is first inserted between the last two spirals or coils. The cylindrical part 502 is then rotated in a screw like fashion until the elongate body 102 advances through the coil at which point the cylindrical part 502 will be disposed around the elongate body 102. It is to be appreciated that similar embodiments of the cylindrical part 502 that facilitate the installation of the cylindrical part 502 on the elongate body 102 without removing the elongate body 102 from the rigid member 104 are within the scope of the innovation.

Still referring to FIG. 5, the casing part 504 is formed from a plurality of continuous-protective rods 512 (hereinafter "rods") and extends in a helical fashion from approximately the first end 506 to approximately the second end 508 of the cylindrical part 502. In one aspect, the rods 512 are formed from an aluminum material, an aluminum coated steel material or any other suitable protective material. The number of rods 512 used in the apparatus 500 is dependent on an outside diameter of the object that the rods 512 protect. For example, in the example embodiment shown in FIGS. 5 and 6, the number of rods 512 is dependent on the outside diameter of the cylindrical part 502. It is desired to use an appropriate number of rods 512 such that the rods 512 substantially encase the cylindrical part 502 to: 1) ensure that the rods 512 prevent the slit 510 from opening and causing a short between the rigid member 104 and the elongate body 102 and/or to prevent the cylindrical part 502 from becoming dislodged from the elongate body; and 2) protect the cylindrical part 502 from damage due to contacting the rigid member 104 or from external forces. In some aspects, the apparatus 500 may be secured to the rigid member 104 using a standard staple or other suitable fastening device. In addition, an internal diameter "d" of the casing part is less than an outside diameter "D" of the cylindrical part 502 (see FIG. 8). The internal diameter "d", however, should be sufficiently large enough so that the elastic limit of the material is not exceeded.

The example embodiment illustrated in FIGS. 5 and 6 and described above reduces installation, replacement, and retrofitting time. Specifically, when installing a conventional tube insulator during the installation of the electric fence, the conventional tube insulator must be slid along the entire length of the wire 102 to its proper location. Further, to replace a damaged conventional tube insulator, the wire 102 must be removed from each and every fence post 104 up to and including the location of the damaged insulator. The wire 102 must then be reattached to each fence post 104 once the damaged conventional tube insulator is replaced. Still further, if an additional fence post 104 is installed after installation of the electric fence is complete (retrofitting), the wire 102 must again be removed from each fence post 104 up to where the new fence post is installed in order to add an additional conventional tube insulator.

On the other hand, the embodiments illustrated in FIGS. 5 and 6 and described above lend itself to easy installation, replacement and retrofitting. Specifically, the inclusion of the angled slit 510 (or the coiled embodiment) allows the cylindrical part 502 to be installed on the wire 102 at the appropriate location along the wire 102 without the need to slide cylindrical part along the wire 102. Thus, the cylindrical part 502, and ultimately the apparatus 500, can be easily and quickly installed, replaced or retrofitted onto the wire 102 without removing the wire 102 from the fence posts 104.

Figure 7:
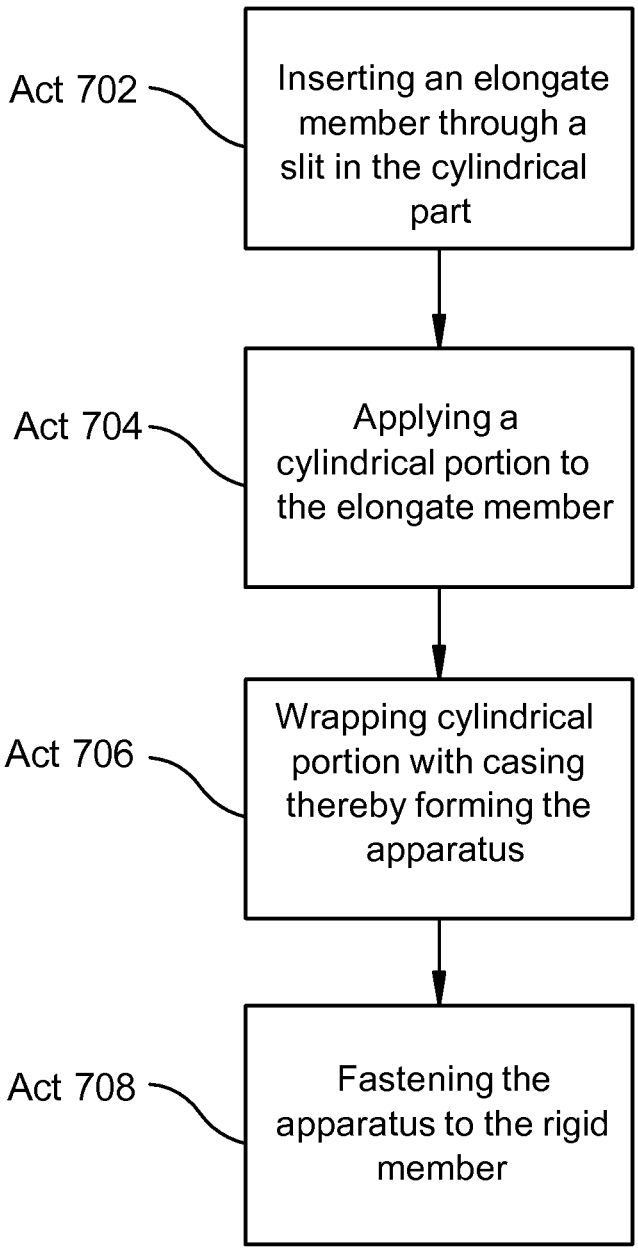
FIG. 7 is an example flowchart illustrating a method of installing the insulator of FIGS. 5 and 6 in accordance with an aspect of the innovation.

For example, FIG. 7 illustrates a method of installing the apparatus 500 illustrated in FIGS. 5 and 6. At Act 702, the elongate body 102 is inserted through the slit 510 in the cylindrical part 502 such that the cylindrical part 502 is applied to and surrounds around the elongate part 102, Act 704. At Act 706, the casing part 504 is wrapped around the cylindrical part 502. The casing part 504 can be applied either as multiple individual rods or in sets (described further below) until the cylindrical part 502 is substantially covered. At Act 708, the apparatus 500 is fastened to the rigid member 104 using a standard staple or other suitable mechanical fastening device. To remove and replace and existing apparatus 500, the above acts are simply reversed and then repeated to install the replacement.

Examples 1-4 in FIG. 8 illustrate proper and improper arrangements of applying the rods 802 to an object 804 like the elongate body or the cylindrical tube, similar to that of a conductor, shown in FIG. 8. It is to be appreciated that the number of rods 802 used in an application varies depending on the diameter of the object 804 (i.e., "D") and the application. Thus, the examples illustrated in FIG. 8 are for illustrative purposes only and are not intended to limit the scope of the innovation.

The optimum application of the rods 802-1 is shown in example 1, where the rods 802-1 are: 1) equally spaced around a perimeter of the object 804-1, and 2) are in contact with the perimeter of the object 804-1. This ensures that the object 804-1 is gripped with substantially equal force around a perimeter of the object 804-1. In addition, this arrangement ensures optimum protection against abrasion to the rods 802-1 and/or the object 804-1.

Example 2 illustrates an acceptable, but not optimum, arrangement of the rods 802-2. In this arrangement, the rods 802-2, although in contact with the perimeter of the object 804-2, are not equally spaced around the perimeter of the object 804-2. While this arrangement is acceptable, it produces a larger gap in one location around the perimeter of the object 804-2. In some instances, this may lead to the addition of applying an extra-unneeded rod (denoted as '12' in example 3). The arrangement of the rods 802-3 in example 3 is unacceptable because the addition of the unneeded rod can lead to potential abrasion to the rods 802-3.

Example 4 is another unacceptable arrangement of the rods 802-4. In this example, again an unneeded rod (denoted as '12' in example 4) is added to make up for the large gap shown in example 3. In this arrangement, however, the rods 802-4 are displaced from the object 804-4 such that the rods 802-4 are equally spaced around the perimeter of the elongate body 804-4. The rods 802-4, however, are no longer in contact with the object 804-4. This arrangement affords little protection to the object 804-4 and can lead to severe abrasion and other damage to the object 804-4.

The rods 802 in the above examples can be applied to the object 804 a single rod at a time or in sets. A set is comprised of two or more rods 802 adhered together with a thermally conductive adhesive, such as aluminum oxide grit, which also aids in the dissipation of heat from the object 804. An inside surface of each rod 802 is coated with the adhesive or grit to hold the rods 802 together thereby forming the set. The example embodiment in FIGS. 5 and 6 is an illustration of a set 604 (see FIG. 6) comprised of three rods 802. Multiple sets can then be applied to the object 804 until the rods 802 encase the object 804, as shown in FIG. 8, example 1.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus that electrically insulates an elongate body from a rigid member comprising:

an insulating part that contacts either the elongate body or the rigid member thereby electrically insulating the elongate body from the rigid member; and a helically shaped securing part that prevents the insulating part from moving or becoming dislodged, the helically shaped securing part comprises a helically shaped first leg; a helically shaped second leg; and a substantially U-shaped part connecting the helically shaped first leg and the helically shaped second leg such that the helically shaped first leg, the helically shape second leg and the U-shaped part are continuous, wherein the helically shaped first leg and the helically shaped second leg are configured to wrap around the elongate body in an alternating arrangement; and wherein the insulating part includes an insulating material disposed between a bight part of the U-shaped part and the rigid member.

2. The apparatus of claim 1, wherein the helically shaped securing part is comprised of a plurality of continuous rods.

3. The apparatus of claim 2, wherein the plurality of continuous rods are arranged around the elongate body such that the plurality of continuous rods are equally spaced and contact a perimeter of the elongate body, and wherein an inside diameter of the helically shaped first leg and an inside diameter of the helically shaped second leg is less than an outside diameter of the elongate body.

4. The apparatus of claim 3, wherein the plurality of continuous rods include individual rods and/or sets of rods where at least two of the plurality of continuous rods are adhered together with an adhesive to form a set, and wherein the adhesive is an aluminum oxide grit that is thermally conductive and facilitates removal of heat from the elongate body.

5. The apparatus of claim 1 further comprising a cylindrical tube disposed around the elongate body and having a first end, a second end, and an angled slit extending from the first end to the second end, and a casing comprised of the helically shaped securing part that wraps around the cylindrical tube in a helical arrangement and substantially encases the cylindrical tube thereby protecting the cylindrical tube from damage due to contact with the rigid member or due to external forces.

6. The apparatus of claim 5, wherein the helically shaped securing part is comprised of a plurality of continuous rods.

7. The apparatus of claim 6, wherein the plurality of continuous rods are arranged around the insulating part such that the plurality of continuous rods are equally spaced and contact a perimeter of the cylindrical tube.

8. The apparatus of claim 7, wherein the plurality of continuous rods are applied to the cylindrical tube individually and/or in sets where at least two of the continuous rods are adhered together with an adhesive to form a set, and wherein the adhesive is an aluminum oxide grit that is thermally conductive and facilitates removal of heat from the elongate body.

9. The apparatus of claim 8, wherein prior to the installation of the plurality of rods on the cylindrical tube, an inside diameter of the helical formation of the plurality of rods is less than an outside diameter of the cylindrical tube.

10. An apparatus that insulates an elongate body from a rigid member comprising:

a helically shaped first leg;

a helically shaped second leg; and a substantially U-shaped part connecting the helically shaped first leg and the helically shaped second leg such that the helically shaped first leg, the helically shaped second leg and the U-shaped part are continuous, the U-shaped part including a bight part and being encompassed by an insulating material disposed between the bight part and the rigid member, wherein the insulating material electrically insulates the elongate member from the rigid member, wherein the helically shaped first leg, the helically shaped second leg, and the U-shaped part are formed from a plurality of continuous rods.

11. The apparatus of claim 10, wherein the plurality of continuous rods include individual rods and/or sets of rods where at least two of the plurality of continuous rods are adhered together with an adhesive to form a set.

12. The apparatus of claim 11, wherein the adhesive is an aluminum oxide grit that is thermally conductive and facilitates the removal of heat from the elongate body.

13. The apparatus of claim 10, wherein a lay direction of the helically shaped first leg and a lay direction of the helically shaped second leg are the same, and wherein the helically shaped first leg and the helically shaped second leg are wrapped around the elongate body in an alternating arrangement.

14. The apparatus of claim 13, wherein an inside diameter of the helically shaped first leg and an inside diameter of the helically shaped second leg is less than an outside diameter of the elongate body.

15. The apparatus of claim 14, wherein the helically shaped first leg, the helically shaped second leg, and the U-shaped part are formed from a plurality of continuous rods, and wherein the plurality of continuous rods are arranged such that the plurality of continuous rods are equally spaced around and contact a perimeter of the elongate body.

16. The apparatus of claim 10, wherein the bight part loops around a back of the rigid member and the helically shaped first leg and the helically shaped second leg engage the elongate body in an alternating arrangement thereby securing the elongate body to the rigid member.

17. The apparatus of claim 16, wherein the insulating material insulates the elongate body from the rigid member.

18. A method of insulating an elongate member from a rigid member comprising:

applying an insulating part to the elongate member;

applying a casing around the insulating part; and securing the casing and insulating part the rigid member with a fastening device, wherein the fastening device includes:

a helically shaped first leg;

a helically shaped second leg; and a substantially U-shaped part connecting the helically shaped first leg and the helically shaped second leg such that the helically shaped first leg, the helically shaped second leg and the U-shaped part are continuous, wherein the helically shaped first leg and the helically shaped second leg are configured to wrap around the elongate body in an alternating arrangement; and wherein the insulating part includes an insulating material disposed between a bight part of the U-shaped part and the rigid member.

19. The method of claim 18 further comprising inserting the elongate member through a slit in the insulating part, wherein the insulating part is a cylindrical tube.

20. The method of claim 19, wherein the casing includes a plurality of helically shaped-continuous rods that wrap around and substantially encase the cylindrical tube.

21. The method of claim 20, wherein the plurality of continuous rods are arranged around the cylindrical tube such that the plurality of continuous rods are equally spaced and contact a perimeter of the cylindrical tube.

22. The method of claim 20, wherein prior to the installation of the plurality of continuous rods on the cylindrical tube, an inside diameter of the helical formation of the plurality of continuous rods is less than an outside diameter of the cylindrical tube.

23. The method of claim 20, wherein the plurality of continuous rods are applied to the cylindrical tube individually and/or in sets where at least two of the continuous rods are adhered together with an adhesive to form a set.

24. The method of claim 23, wherein the adhesive is an aluminum oxide grit that is thermally conductive and facilitates removal of heat from the elongate body.

* * * * *